United States Patent [19]

Taub

[11] Patent Number: 5,048,305

[45] Date of Patent: Sep. 17, 1991

[54] COOLER ASSEMBLY

[76] Inventor: Ronald Taub, 1154 Sheridan Rd., Highland Park, Ill. 60035

[21] Appl. No.: 575,224

[22] Filed: Aug. 30, 1990

[51] Int. Cl.[5] ..... F25D 3/08

[52] U.S. Cl. ..... 62/372; 62/457.4; 220/408

[58] Field of Search ..... 62/457.1, 457.4, 457.5, 62/372, 459, 464; 220/23.83, 23.86, 339, 408; 49/397

[56] References Cited

U.S. PATENT DOCUMENTS

| | | | |
|---|---|---|---|
| 1,108,017 | 8/1914 | Steel | 62/457.5 X |
| 3,717,278 | 2/1973 | Mari | 220/339 |
| 4,633,678 | 1/1987 | Lea et al. | 62/464 X |
| 4,724,682 | 2/1988 | Flum et al. | 62/457.5 X |
| 4,782,670 | 11/1988 | Long et al. | 62/457.4 |
| 4,787,532 | 11/1988 | Borjesson | 62/464 X |
| 4,813,243 | 3/1989 | Woods et al. | 62/457.5 X |
| 4,835,985 | 6/1989 | Ilvento | 62/464 X |
| 4,946,032 | 8/1990 | Stoddard et al. | 62/372 X |

*Primary Examiner*—William E. Tapolcai
*Attorney, Agent, or Firm*—Michael G. Berkman

[57] ABSTRACT

A cooler assembly of a molded plastics composition for the storage of ice-cooled, canned beverages and the like. An ice-cooled storage vessel, suspended within a self-supporting cylindrical housing of the assembly is formed with an array of vertically disposed, hollow, panel-like spacers in the lower sump zone of the vessel. Water formed during the melting of the ice collects in the sump and the spacers support the vessel-housed cans so that the spacers prevent contact of the cans with the sump water. A drain at the base of the storage vessel facilitates periodic emptying of the sump, as required. A top closure or cover of the assembly includes a positively-anchored fixed sector and an integrally formed, hingedly connected second pivotal section, thereby to permit convenient access into the storage vessel while obviating separation of the closure from the assembly.

24 Claims, 5 Drawing Sheets

FIG.6
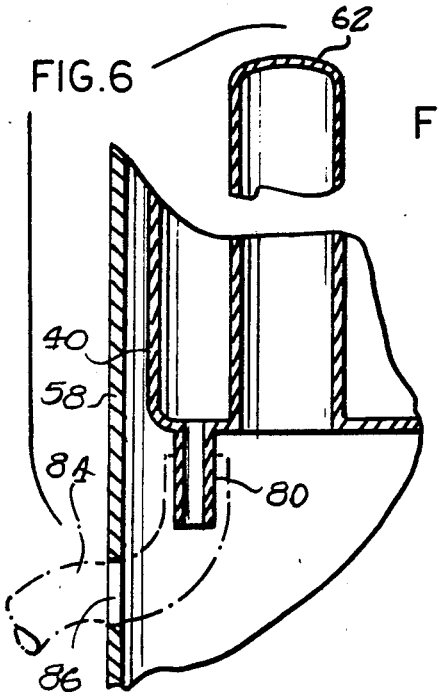
FIG 7
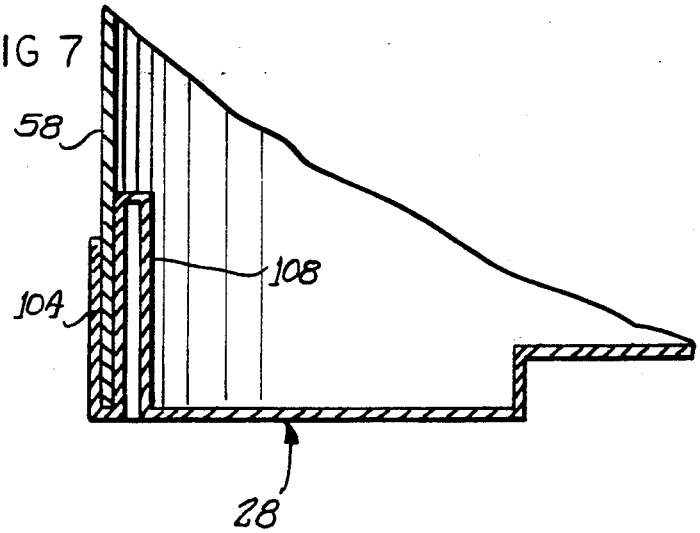
FIG.8
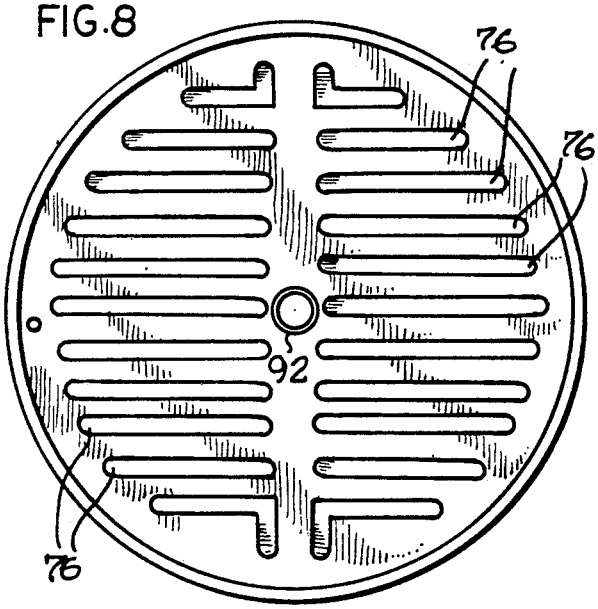
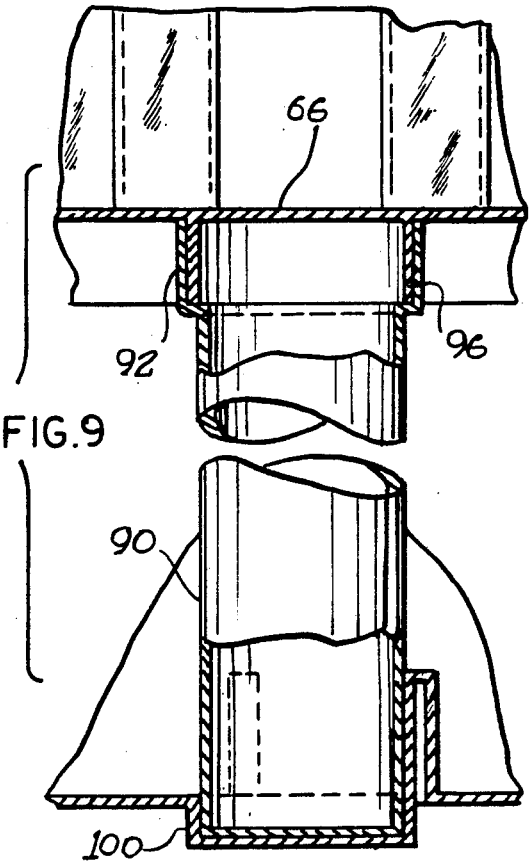
FIG.9

COOLER ASSEMBLY

FIELD AND BACKGROUND OF THE INVENTION

The present invention relates to a cooler assembly of the type which is self-contained and self-supporting and is adapted to be used for the cooled storage of beverages, such as canned beverages. More particularly, the present invention is directed to an ice-cooled storage assembly in which the containers to be cooled are packed in ice cubes or other particulate ice, or ice bags that are frozen with ready access to the interior of the cooled vessel to retrieve a selected can of a cooled beverage.

Storage containers of the general type described above are known in the art, and such containers have taken various shapes and physical forms. However, prior art storage coolers are not without objectionable features. For example, in many of the prior art structures, as the ice melts, the cans become inundated with water. This water often has the effect of causing separation of the can labels from the containers themselves rendering the "blank" cans essentially unsalable. The accumulation of the water as a medium in which the cans lie has the undesirable effect of impairing the degree of sanitization achievable and maintainable.

It is, therefore, a principal aim of the present invention to provide a simple storage cooler for cans and the like and in which many of the shortcomings of prior art coolers are obviated.

BRIEF SUMMARY OF THE INVENTION

The present invention comprises a cooler of a molded plastics composition and which includes a storage vessel in which an aggregate of ice cubes and canned beverages is filled, the vessel being readily accessible for the retrieval of a selectable cooled beverage can, as required. In the present invention, the storage vessel itself is supported on the edge of a surrounding, generally cylindrical housing and to depend within the principal cavity of the housing. In the arrangement described, the housing contributes to the effective insulation of the storage vessel itself and, additionally, the vessel is supported in an upper zone of the floor-standing cylindrical housing.

It is an important feature of the cooler assembly of the invention that the storage vessel is integrally formed at its base with an upstanding array of panel-like spacers or open ended rings. These spacers or rings delineate, in the lower zone of the storage vessel, a sump or sump zone in which water derived from the melting of the ice is collected. The hollow panel-like spacers or rings are of a substantial vertical height, so that they serve effectively to support the cans of beverages well above the water level in the sump. The spacers or supports are integrally formed with the storage vessel so that they cannot be inadvertently separated or misplaced.

It is an important feature of one embodiment of the cooler of the invention that the storage vessel in which the ice-cooled cans are retained is suspended within an outer, surrounding, generally cylindrical shell or housing, the walls of the storage receptacle being spaced from the outer enveloping walls of the housing, so that a significant degree of insulation is provided, enhancing the useful life of the ice stored in the cooling vessel.

In another embodiment of the cooler of the invention, the vessel is of double walled construction with an insulating foam filler.

In one embodiment of the invention the articles to be cooled are stored in the cooler in a manner to prevent direct contact with the cooling ice or its melt.

In a preferred embodiment of the invention a tubular central core supported within the article storage chamber serves as a reservoir for ice cubes or bagged ice, about which the articles to be cooled are distributed in heat exchange relationship therewith.

It is a related feature of the invention that the ice-filled core is formed with openings for discharge of melt water which would otherwise accumulate. A plate in the cooling chamber supports the articles above a melt-water accumulating sump.

While the volume afforded below the upper level of the hollow, panel-like spacers or the upstanding rings, is quite considerable, allowing for the accumulation of a significant amount of water below the can-contacting level, there is provided a simple drain attachment, including a lead and associated line, by means of which the sump may be periodically emptied, as required.

In a preferred embodiment of the invention, the storage vessel is conveniently supported in its functional mode by means of a downwardly-opening, circumscribing trough-like lip which overhangs the upstanding upper edge of the supporting shell or housing of the assembly.

In an alternate embodiment of this invention the cooler is positioned on a supporting pedestal.

In the embodiment of the invention illustrated, the hanging, rim-supported storage vessel tapers inwardly and downwardly so as to facilitate its insertion into the encircling housing.

A base plate, or separate floor, for the cylindrical shell is formed with an upstanding, annular, circumscribing flange spaced from an array of posts to define therebetween an annular slot for receiving a lower end of the cylindrical housing therewithin in a physically stabilized configuration.

In one embodiment of the invention the cooler component of the assembly is supported on a base or pedestal, preferably of a reduced diameter, thus facilitating shipment and storage, and reducing shipping costs by conserving space.

Further to enhance the physical strength and stability of the assembly, there is provided a vertically extending tubular post fixedly secured to extend between the bottom closure of the storage vessel, and the base plate of the enveloping housing, whereby the bottom of the storage vessel is stabilized against downwardly stressing forces applied thereto.

In a preferred embodiment of the invention, the storage and refrigerator assembly includes a cover formed with an integral hinge facilitating access to the beverage containers stored within the cooling vessel. A fixed sector of the cover is firmly held in place, obviating inadvertent separation of the cover from the remainder of the assembly.

It is a practical and very important advantage of the invention that the entire assembly is fabricated of an essentially inert plastics composition, so that corrosion and rust and water pose no problems.

A related feature of the invention is that the entire assembly may be readily cleaned with proper disinfectants as may be appropriate from time-to-time in order to ensure full compliance with established health practices.

Other and further objects, features and advantages of the invention will become evident upon a reading of the specification considered in conjunction with the drawings.

BRIEF DESCRIPTION OF THE DRAWINGS

FIG. 6 is an enlarged, fragmentary view of the area circled in FIG. 2 and showing the manner in which a sump drain is attached to the storage vessel, and showing a detail of one of the can-supporting spacers of the invention;

FIG. 7 is an enlarged, fragmentary view of the area encircled in FIG. 2 and showing the lower end of the housing seated in a base plate of the cooler assembly.

FIG. 8 is a bottom plan view of the internal storage vessel of the assembly, showing the array of projecting, hollow, can-supporting panels, in accordance with the invention;

FIG. 9 is an enlarged, fragmentary, cross-sectional view, with parts broken away, showing the internal, central post support for the can storage vessel;

DETAILED DESCRIPTION OF ILLUSTRATED EMBODIMENT

The aims and objects of the invention are accomplished by providing, as a cooler for beverage cans and the like, an ice-cooled storage vessel suspended within an outer shell or housing and provided with a pivotally manipulable cover. The entire assembly is of a self-supporting, semi-rigid, molded plastics composition, and the storage vessel itself is characterized in that it includes as projections extending upwardly from a base thereof an array of panels, rings, or struts, the panels being preferably hollow. These integrally formed supports establish a sump in the base of the storage vessel so that water derived from a melting of the cooling ice is maintained isolated from the beverage containers which are housed in the cooling vessel. Deleterious effects of sustained and continuous contact between the stored cans and the melt water are avoided. The labels remain in place on the cans and the degree of sanitation is enhanced.

In one embodiment of the invention, the cooling ice is in heat-exchange relationship with the articles to be cooled, but is in an out-of-contact physical relationship therewith.

In the preferred embodiment of the invention illustrated, a simple drain orifice and associated drain line are provided for ease in periodically emptying the sump. Additionally, a pillar-like post, extending between the base of the assembly and the floor of the storage vessel strengthens and stabilizes the latter. The entire assembly is readily cleanable in a most practical sense, and completely obviates any possibility of corrosion or rusting.

In one embodiment of the invention, the cooling vessel is supported on a pedestal or base which can be stored in the vessel during shipment.

Figure 1:
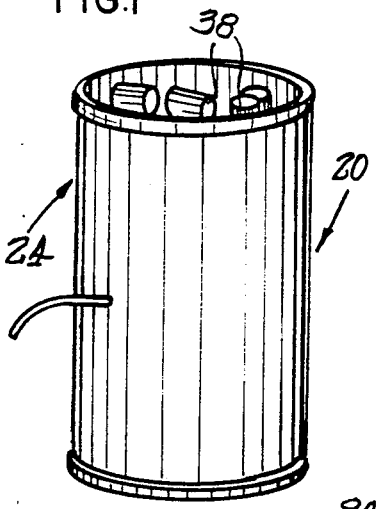
FIG. 1 is a perspective view of a cooler assembly in accordance with the invention, with the cover unit removed.
Figure 2:
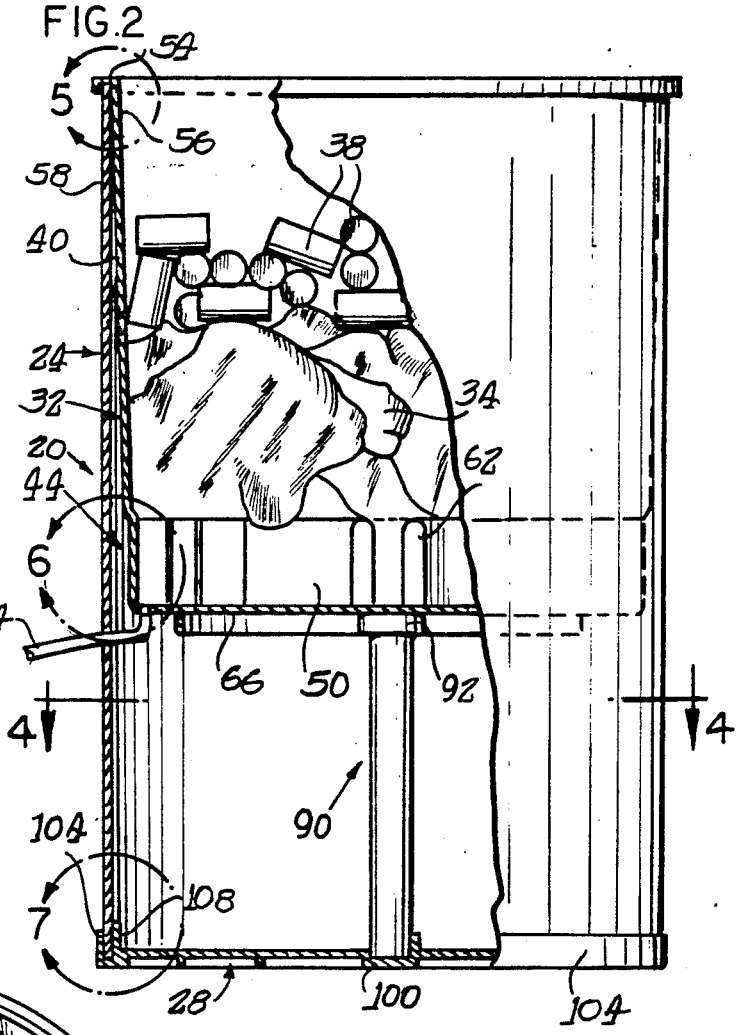
FIG. 2 is a vertical cross-sectional view of a cooler assembly embodying the features of the invention.

Referring now to the drawings, for purposes of disclosure and not in any limiting sense, the cooler assembly 20 of the invention is shown in FIGS. 1 and 2, as embodying a generally cylindrical outer housing 24 having a base or baseplate 28, and a storage vessel 32 for ice 34 and beverage containers 38.

Figure 5:
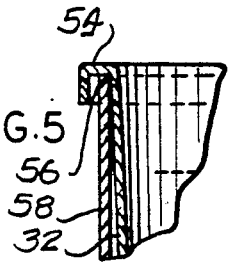
FIG. 5 is an enlarged, fragmentary view of the area encircled in FIG. 2, and showing the trough-like lip of the storage vessel, by means of which the vessel is supported on to depend from the outer, cylindrical housing.

The bounding, generally cylindrical wall 40 of the storage vessel 32 tapers inwardly from top to bottom and forms a sump zone 50 at a lower section 44 of the vessel 32. At its upper circumambient edge the storage vessel 32 is formed with a downwardly opening trough-like flange 54 which overlies and bears upon an abutting upper edge 56 of the cylindrical wall 58 of the cooler housing 24, as shown in FIGS. 2 and 5.

Figure 3:
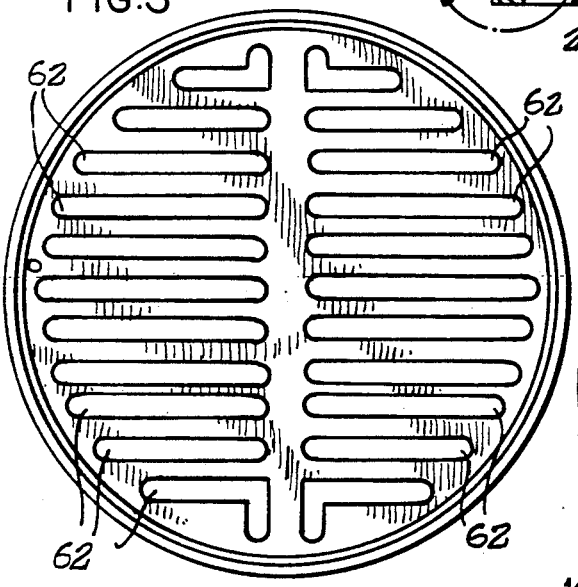
FIG. 3 is a top plan view of the can-supporting array of hollow spacers at the base of the storage vessel of the cooler assembly.

Referring further to the storage vessel 32 and as shown in FIGS. 2, 3 and 8, the sump zone 50 is integrally formed with an array of upstanding, struts, rings, or hollow panels 62 so spaced relative to one another as to function as spacers for elevating the stored ice 34 and cooled cans 38 above the floor 66 of the storage vessel 32 and above the sump zone 50. While the dimensions set forth are in no sense intended to be limiting or critical, in the particular embodiment of the invention illustrated, and in which the diameter of the storage vessel is about 20 inches, the height to which the spacers 62 extend above the floor 66 is about 3 inches, the hollow panels themselves are about $\frac{3}{8}$ inch in width, and the space between adjacent panels 62 is about $1\frac{1}{4}$ inches. One suitable physical arrangement of the array of spacers or elevators 62 is shown in FIG. 3, and the appearance of the underside of the storage container 2 is shown in FIG. 8, which illustrates the arrangement of the openings 76, whose bounding walls define the panels 62.

As shown in FIGS. 2 and 6, a drain nipple 80 integrally formed with the floor 66 of the storage vessel 32 communicates with the interior of the vessel for draining the sump 50 through a connectable hose 84, a suitable opening 86 being formed in the cylindrical wall 58 for passage of the hose 84 therethrough.

Stabilization of the floor 66 of the storage container 32 and an enhancement of its weight-carrying capacity is ensured through the expedient of a pipe-like tube or column 90 which extends between the base 28 of the outer housing 24 and the floor 66 of the storage vessel 32. As shown in FIGS. 2 and 9, the support column 90 is formed with a slightly enlarged cup or collar portion 92 which slidably receives therewithin a depending annular neck or frame-like flange 96 integrally formed to extend downwardly from an underside of the floor 66 of the storage vessel 32. At its lower end the column 90 nests within a cooperating guide socket 100 delineated by pins 102.

Figure 4:
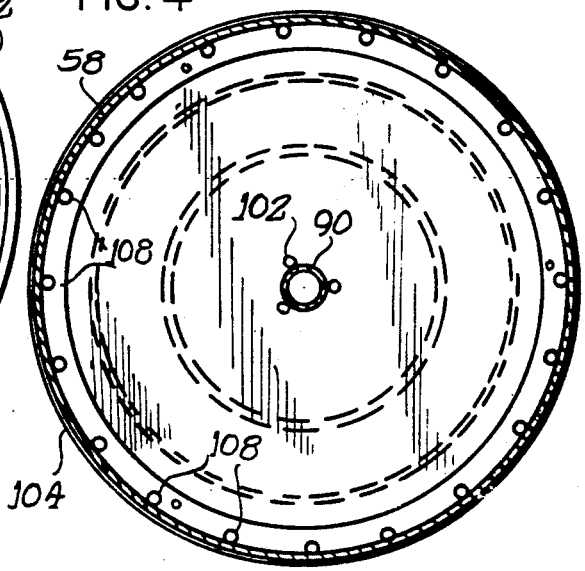
FIG. 4 is a cross-sectional view taken substantially on the lines 4—4 of FIG. 2 and showing the configuration of the base plate of the housing of the cooler assembly.
Figure 10:
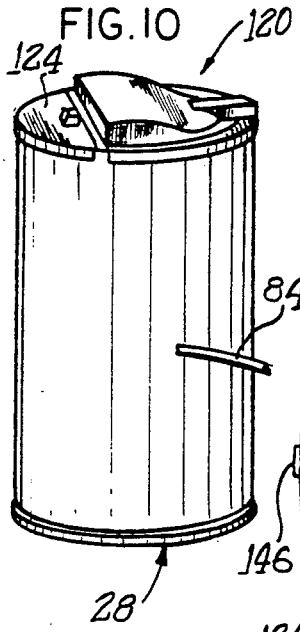
FIG. 10 is a perspective view of the cooler assembly of the invention with the closure top in place.
Figure 11:
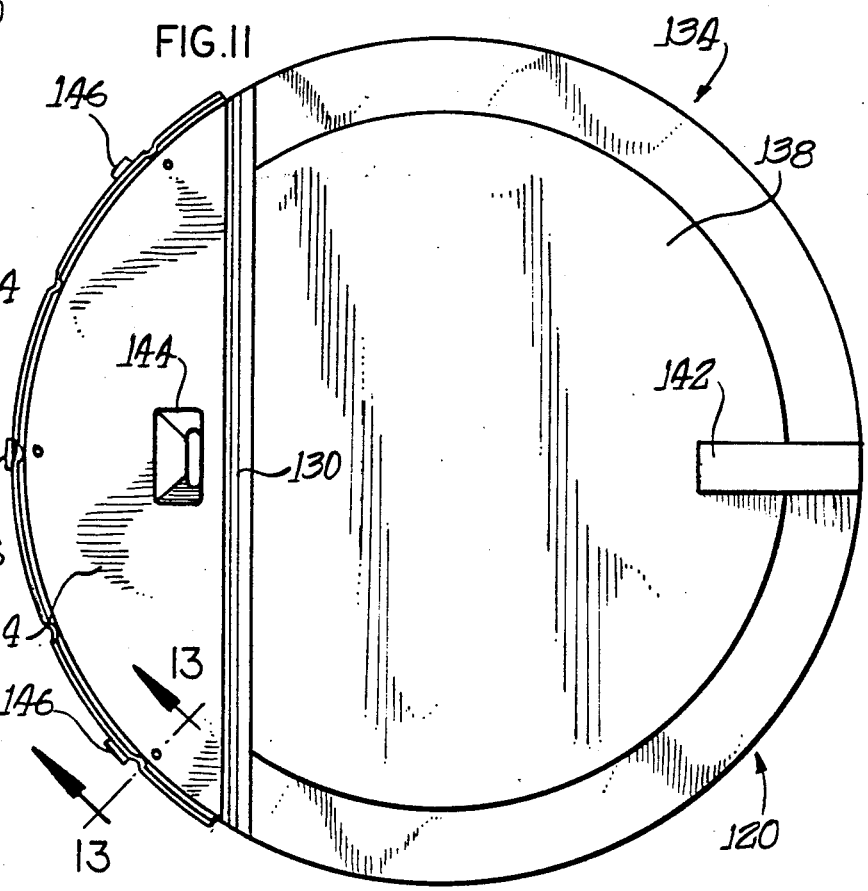
FIG. 11 is a top plan view of the closed cooler assembly of the invention.
Figure 12:
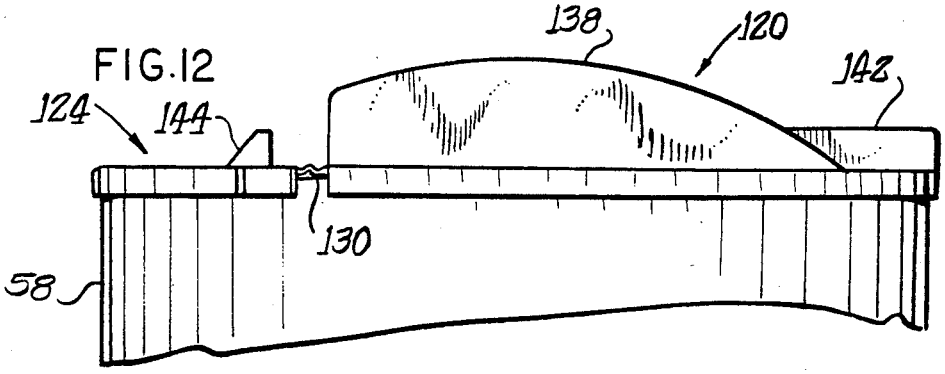
FIG. 12 is a fragmentary, side-elevational view of the assembly taken near the top and showing the two-component cover joined by an integrally-formed live hinge.
Figure 13:
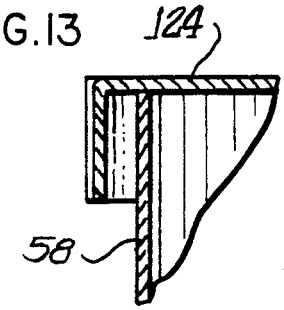
FIG. 13 is a cross-sectional view taken substantially along the lines 13—13 of FIG. 11.

As shown in FIGS. 2 and 4, the base 28 of the cylindrical housing 24 is formed with an upstanding outer rim 104 and a series of radially inwardly displaced stub posts 108 distributed as an annular array (FIG. 4). The radial space between the upstanding web 104 and the posts 108 is sized to accommodate the cylindrical wall 58 of the housing 24.

In one embodiment of the cooler assembly 20 of the invention, and as shown in FIGS. 10–13, there is provided a top closure 120 sized to overlie and bear upon an upper edge 54 of the assembly 20. The closure itself includes a relatively fixed sector 124, to which there is attached by means of a "live hinge" 130, a principal cover component 134 having a vaulted portion 138 and a hand grip zone 142. A wedge-like upwardly directed projection 144 acts as a mechanical stop when the pivotal portion 134 of the cover is lifted to an upstanding, reservoir opening mode. The stop 144 protects the headers (not shown), which may be fastened in cover-mounted clips 146. Alternatively, the clips may be attached to the housing of the cooler.

Figure 14:
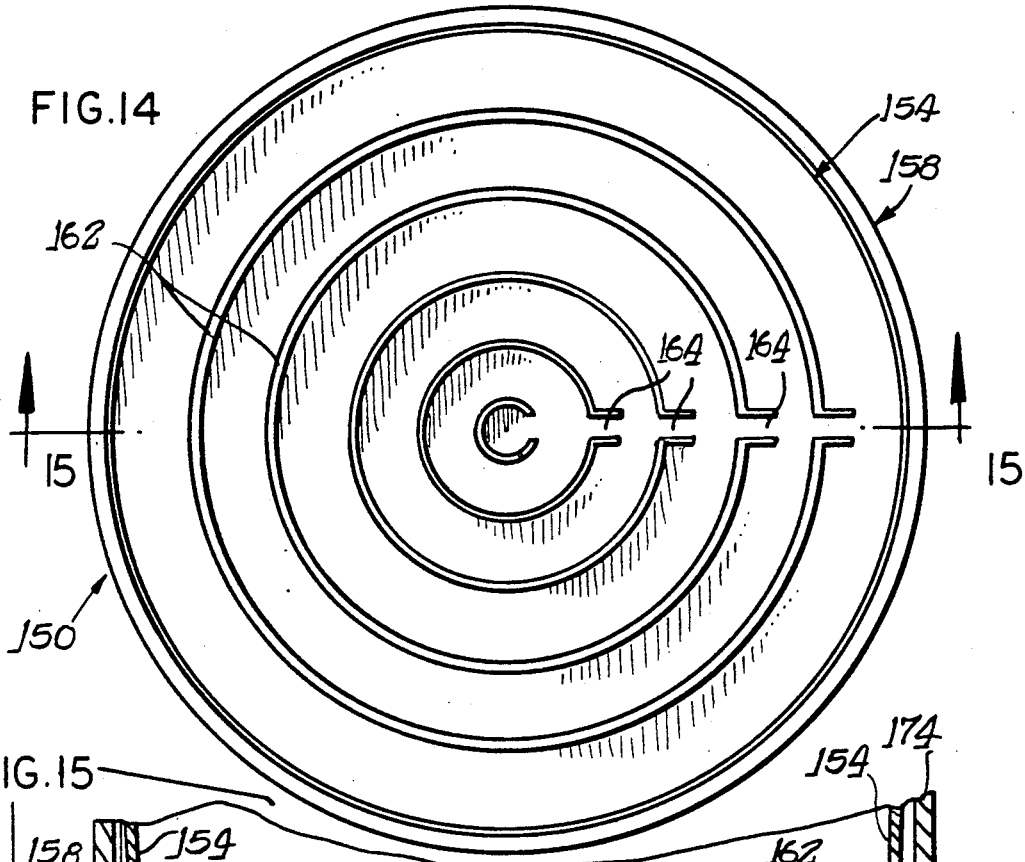
FIG. 14 is a top plan view showing a second type of can-supporting spacer defining a sump zone and taking the form of concentric rings with open sections.
Figure 15:
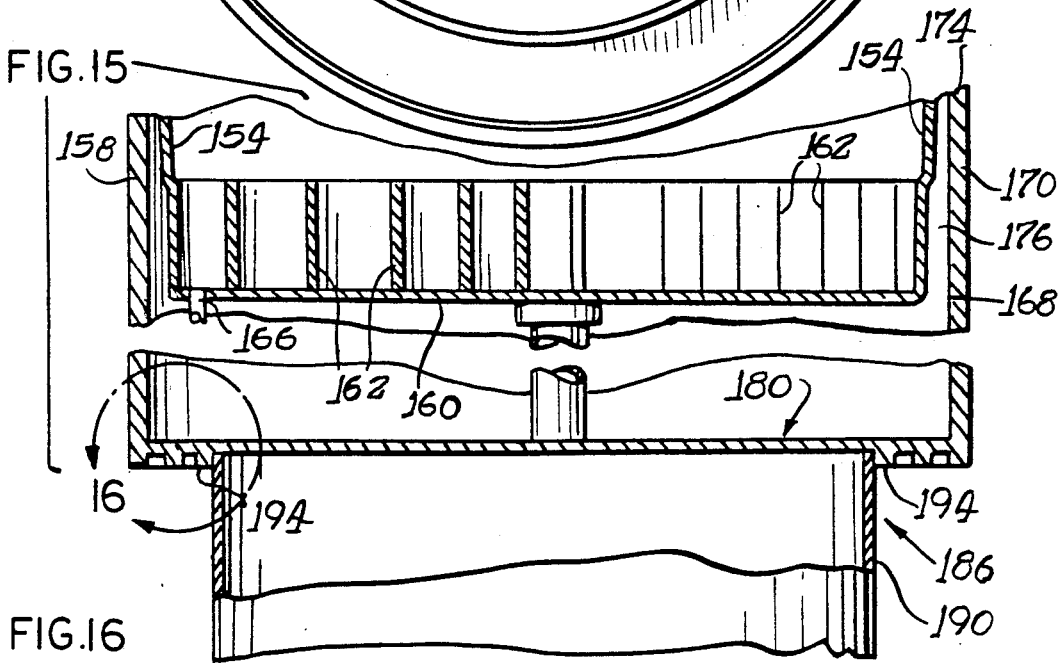
FIG. 15 is a cross-sectional view taken substantially on the lines 15–15 of FIG. 14 and showing the insulation-filled bounding wall of the cooler, and the upstanding can-support rings.
Figure 16:
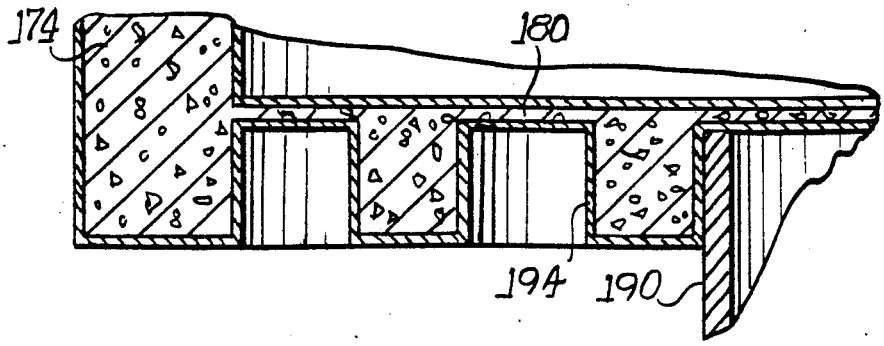
FIG. 16 is an enlarged view of the zone circled in FIG. 15 and showing foam insulation in the double-walled cooler and the base construction.
Figure 18:
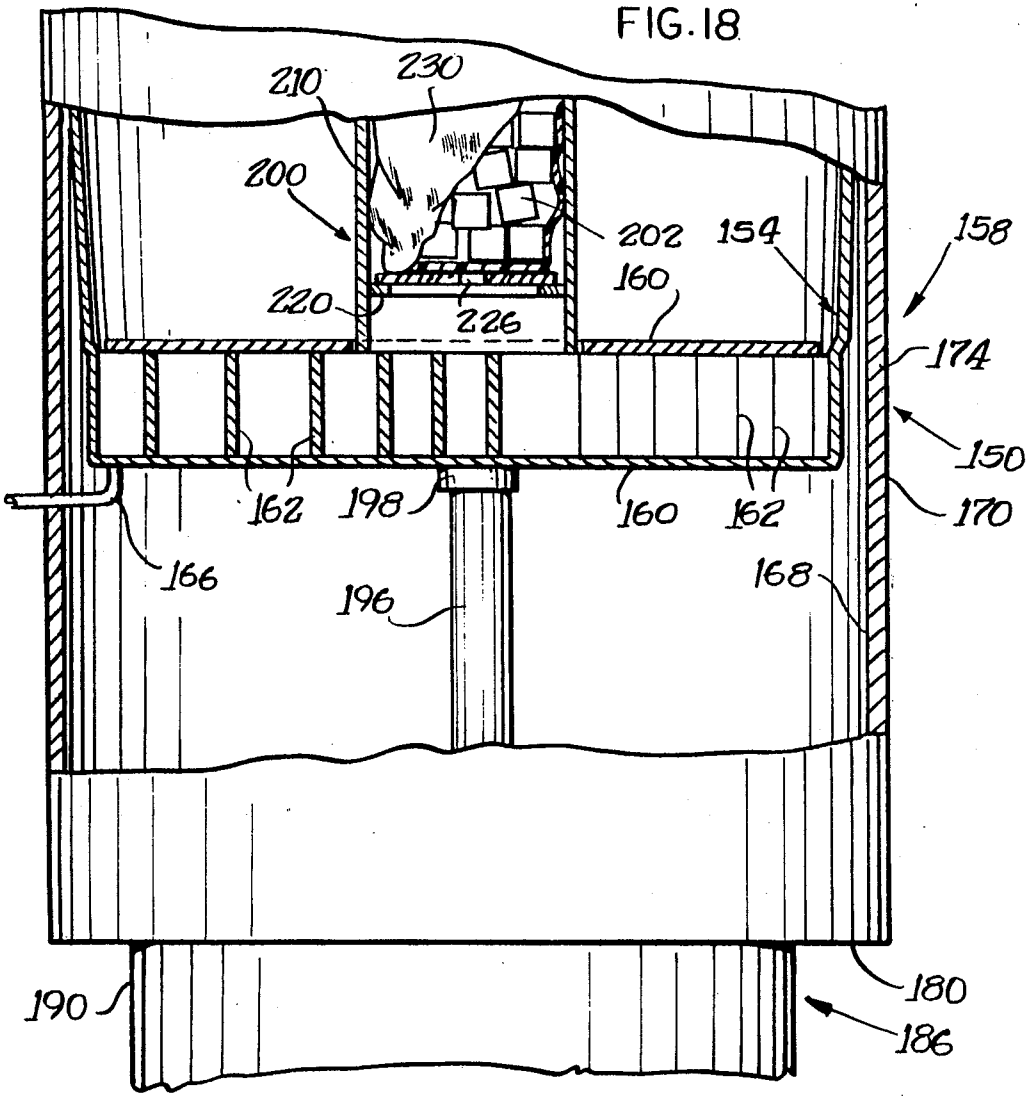
FIG. 18 is a fragmentary, cross-sectional view of the cooler of FIG. 17 and showing an ice-isolating, central, ice-storing cooler core, in accordance with the invention.
Figure 17:
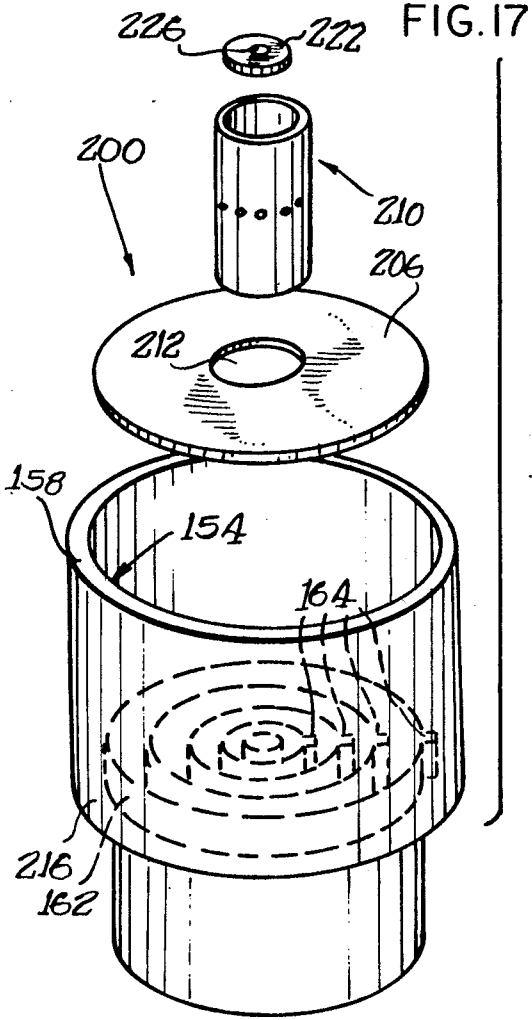
FIG. 17 is an exploded view of a modified structure of the invention and in which the cooler itself is supportedly positioned on a support base or pedestal, preferably of a reduced diameter.

In the embodiment of the invention shown in FIGS. 14–18, the cooler assembly 150 includes a unitary inner vessel 154 sleeved in an outer vessel 158. The inner vessel is integrally formed with a floor 160 and floor-supported, upstanding spacers 162 which take the form of annular wall-like flanges, bands or rings (FIGS. 14, 17 and 18). The latter have open sections 164 to provide communicating passageways for travel of the melt water to an exit port and discharge line 166, as previously described.

The outer wall 158 may be a double-walled vessel generally cylindrical in form, whose concentric walls 168 and 170 are spaced radially to define an annular interspace which is preferably filled with an insulating foam material 174 of a polymerized plastics composition. The space 176 between the principal structural walls 154 and 158 may also be filled with a foam of plastics composition.

The cooler structure shown in FIGS. 1 and 2 is characterized by a full-length, uninterrupted outer bounding housing wall 24 resting on a support substrate. In the embodiment of the cooler assembly depicted in FIGS. 15, 17 and 18, the storage cooler 150 is shown as including a cooler vessel 150 of somewhat lesser overall height. The outer wall 170 of the assembly is nested in or otherwise attached to a base plate 180. The cooler assembly 150 surmounts and is supported on a separate cylindrical structural stand or pedestal 186. In a preferred embodiment of the invention the cylindrical wall 190 of the pedestal 186 is in restrictive and embracing registry with the concentric ring 194 formed on an underside of the plate 180. The pedestal 186 may be fabricated of any preferred material including fiberboard or plastics.

As shown, the cylindrical pedestal 186 is of a lesser diameter than the inner diameter of the surmounting cooler vessel 150 and aligns coaxially with the cooler itself. The size relationship described facilitates a nesting storage of the pedestal 186 within the cooler 150 during shipment, thus affording important savings in shipping space and in associated costs.

A hollow pier 196 in the form of a tube or pipe seated in a collar 198 extends between the base 180 of the outer vessel 158 and the floor 160 of the inner vessel 154 to add further support to the product-storage vessel.

Referring now to FIGS. 17 and 18, the embodiment of the cooler there shown includes an auxiliary internal assembly 200, by means of which the cooling ice 202 is physically isolated from contact with articles to be cooled. As seen in FIG. 17, a product-supporting floor panel 206 of the assembly seats on the upstanding flanges or ring-like spacers 162 in the cooler vessel 150 and completely covers its a real expanse.

A generally cylindrical tube-like core 210 seats within a central opening 212 in the floor panel 206 and communicates at its open-ended base with the sump zone 216 of the cooler. A radially inwardly directed flange 220 of the core 210 supports a disc 222, the latter having a drain port 226 through which water from melted ice is delivered to the sump. The core 210 is adapted to retain a cooling medium; for example, ice cubes 202 or ice cubes in a bag 230.

It will be appreciated that the simple, yet highly efficacious structures which characterize the present invention provide meaningful solutions to important practical problems. While the present invention has been described with reference to preferred embodiments, it is obvious that many changes may be made in the size, composition, shape, details and arrangements of the various elements of the invention without departing from the scope and spirit thereof. It is, therefore, intended to include within the appended claims, all such variations and modifications.

What is claimed is:

1. A cooler for the storage of canned beverages and the like therein, to be retrieved therefrom, said cooler being adapted to use ice as a cooling medium;

said cooler comprising an outer cylindrical housing having an upper rim and a circumambient annular lower edge;

tubular vessel means of self-supporting plastics composition sleeved within said housing for holding beverages to be cooled therewithin;

said vessel means having an integrally formed bottom closure as a floor thereof; and strut-like spacer means integrally formed with said vessel means, said spacer means being disposed as an array and having closed upper ends to prevent accumulating of fluid therewithin, said spacer means projecting upwardly of said vessel means for supporting beverage containers thereon, the beverage containers being in an elevated mode and being ice-cooled in said vessel means;

said spacer means delineating therebetween and in combination with a lower annular sector and said bottom closure of said vessel means, sump means for receiving and retaining therein water formed from melting of ice contained in said vessel means.

2. The structure as set forth in claim 1 and further comprising drain means connected to said vessel means for facilitating the draining from said sump means of water collected therein.

3. The structure as set forth in claim 1 and further comprising hanger means connected to said storage vessel means at a surmounting edge zone thereof and bearing on said cylindrical housing at an upper rim of said housing for supporting said vessel means to depend from said housing and therewithin.

4. The structure as set forth in claim 1 wherein said vessel means includes a circumscribing principal wall which tapers inwardly from top to bottom and is generally frusto-conical in configuration.

5. The structure as set forth in claim 1 and further comprising a baseplate for said cylindrical housing, said baseplate comprising a circular sheet of plastics material having a diameter which exceeds somewhat a diameter of said cylindrical body, and wherein said sheet is formed with upwardly opening annular slot means having a lateral dimension sufficient to accept therewithin a downwardly-directed end edge of said cylindrical housing.

6. The structure as set forth in claim 3 and further comprising auxiliary means for supporting said vessel means in said cylindrical housing.

7. The structure as set forth in claim 6 wherein said auxiliary means comprises post means interposed between and extending between said bottom closure of said vessel means and said base plate of said housing for supporting said bottom closure of said vessel means.

8. The structure as set forth in claim 7 and further comprising coupling means formed in each said bottom closure of said vessel means and said baseplate of said housing for engaging said post means to restrain said post means against lateral displacement and to maintain said post means in a weight-supporting, functional mode.

9. The structure as set forth in claim 1 and further comprising cover means for said cylindrical housing and for said storage vessel means supported therein;

said cover means comprising a fixed chordal section secured to said cooler at a top edge thereof, a pivotally manipulable principal section and an integrally formed live hinge, said hinge being joined to and connecting said fixed chordal section with said manipulable principal section whereby said principal section of said cover means can be pivotally elevated to provide access to the interior of said vessel means, without concurrent dislocation and separation of said cover means from said housing.

10. The structure as set forth in claim 1 wherein said spacer means define elongate hollow panels distributed as an array and projecting upwardly from a floor of said vessel means.

11. The structure as set forth in claim 3 wherein said hanger means comprises an overhanging, downwardly-opening trough-like lip integrally formed with said vessel means at an upper limit thereof and adapted to receive upwardly therewithin said upper rim of said cylindrical housing.

12. The structure as set forth in claim 1 wherein said spacer means comprise an array of double-walled, hollow panels.

13. The structure as set forth in claim 1 wherein said housing and said tubular vessel means sleeved therewithin define an annular spacing therebetween, said spacing enveloping a bounding all of said tubular vessel means and coextensive therewith as thermal insulation therefor.

14. The structure as set forth in claim 13 and further comprising foam composition means disposed in said spacing between said housing and said tubular vessel means for insulating an interior chamber of said cooler from the ambient environment.

15. The structure as set forth in claim 1 wherein said bottom closure of said vessel means is displaced upwardly of a lower limit of said housing.

16. The structure as set forth in claim 1 and further comprising pedestal means for supporting said cooler positioned thereupon.

17. The structure as set forth in claim 9 and further comprising mechanical stop means integrally formed with said cover means for limiting the extent of hinged pivotal displacement of said manipulable principal section of said cover means.

18. The structure as set forth in claim 9 and further comprising clip means for carrying headers with indicia displayed thereon, and fastener means for securing said clip means on said cover means of said cooler.

19. The structure as set forth in claim 17 and further comprising clip means carried on said housing, and wherein said stop means in said cover means comprises means for protecting indicia carrying header means to be fastened to said clip means of said housing.

20. The structure as set forth in claim 16 wherein said pedestal means is of restricted dimensions for facilitating storage of said pedestal means within said vessel means during shipment of said cooler.

21. The structure as set forth in claim 1 and further comprising clip means for supporting headers, and fastener means for securing said clip means to said cooler.

22. A cooler for the storage of canned beverages and the like therein, to be retrieved therefrom, said cooler being adapted to use ice as a cooling medium;

said cooler comprising an outer cylindrical housing having an upper rim and a circumambient annular lower edge;

cylindrical vessel means of rigid self-supporting plastics composition sleeved coaxially within said housing for holding beverages to be cooled therewithin;

said vessel means having an integrally formed bottom closure as a floor thereof;

means connecting said storage vessel means at a surmounting edge zone thereof to said cylindrical housing at an upper rim thereof, said floor of said vessel means being elevated with respect to said lower edge of said housing, a baseplate for said cylindrical housing, said baseplate being formed with annular channel means for receiving a downwardly-directed and lower edge of said housing therein, and post means interposed between and extending vertically between said floor of said vessel means and said baseplate of said housing and supporting said vessel means within said housing.

23. The structure as set forth in claim 21 and further comprising:

strut-like spacer means integrally formed with said vessel means, said spacer means being disposed as an array and projecting upwardly of said vessel means for supporting beverage containers thereon, the beverage containers being in an elevated mode and being ice-cooled in said vessel means;

said spacer means delineating therebetween and in combination with a lower annular sector and said bottom closure of said vessel means, sump means for receiving and retaining therein water formed from melting of ice contained in said vessel means.

24. A cooler assembly including floored chamber means for housing ice and articles to be cooled by ice stored in said chamber means;

pedestal means positionable beneath a floor of said chamber means for supporting said chamber means in an elevated mode;

said pedestal means;

having bounding outer dimensions which measure less than interior dimensions of said floored chamber means, for facilitating nesting entry of said pedestal means into said chamber means completely therewithin to assume a convenient and spacer-saving storage mode of said pedestal means within said chamber means.

* * * * *